US005453590A

United States Patent [19]

Mayer

[11] Patent Number: 5,453,590

[45] Date of Patent: Sep. 26, 1995

[54] BISTABLE MICROSWITCH

[75] Inventor: Wolfgang Mayer, Haar, Germany

[73] Assignee: Schaltbau Aktiengesellschaft, Munich, Germany

[21] Appl. No.: 221,805

[22] Filed: Apr. 1, 1994

[30] Foreign Application Priority Data

Apr. 2, 1993 [DE] Germany ..... 93 05 074 U

[51] Int. Cl.[6] ..... H01H 5/18

[52] U.S. Cl. ..... 200/461; 200/DIG. 42

[58] Field of Search ..... 200/461, DIG. 42, 200/460, 451, 467

[56] References Cited

U.S. PATENT DOCUMENTS

| | | | |
|---|---|---|---|
| 3,996,435 | 12/1976 | King . | |
| 4,347,415 | 8/1982 | Falchi | 200/DIG. 42 |
| 4,362,910 | 12/1982 | Boebel et al. | 200/467 |
| 4,647,727 | 3/1987 | Sontheimer | 200/DIG. 42 |
| 4,736,514 | 4/1988 | McIntosh | 200/DIG. 42 |
| 5,082,997 | 1/1972 | Vialy | 200/460 |

FOREIGN PATENT DOCUMENTS

| | | |
|---|---|---|
| 2449120C2 | 4/1983 | Germany . |
| 3203239A1 | 8/1983 | Germany . |
| 1021744 | 3/1966 | United Kingdom . |
| 1480083 | 7/1977 | United Kingdom . |

*Primary Examiner*—Renee S. Luebke

*Attorney, Agent, or Firm*—Graybeal Jackson Haley & Johnson

[57] ABSTRACT

A microswitch comprising a housing, a switching tappet, connection contacts connected with fixed contacts positioned in the interior of said housing, and a contact bridge with at least one switching contact movable from a first to a second switching position by way of the switching tappet. The contact bridge is held in its first or second switching position by means of a bistable spring arrangement. The microswitch has structurally simple forced, separation means without any necessity for change in the overall size. Its switching tappet is provided with a cantilever with a holding-down device at one end which, in the first switching position of the contact bridge is arranged at a small distance from said contact bridge and which, in the second switching position, projects into the path along which the contact bridge moves.

16 Claims, 3 Drawing Sheets

BISTABLE MICROSWITCH

Figure 1:
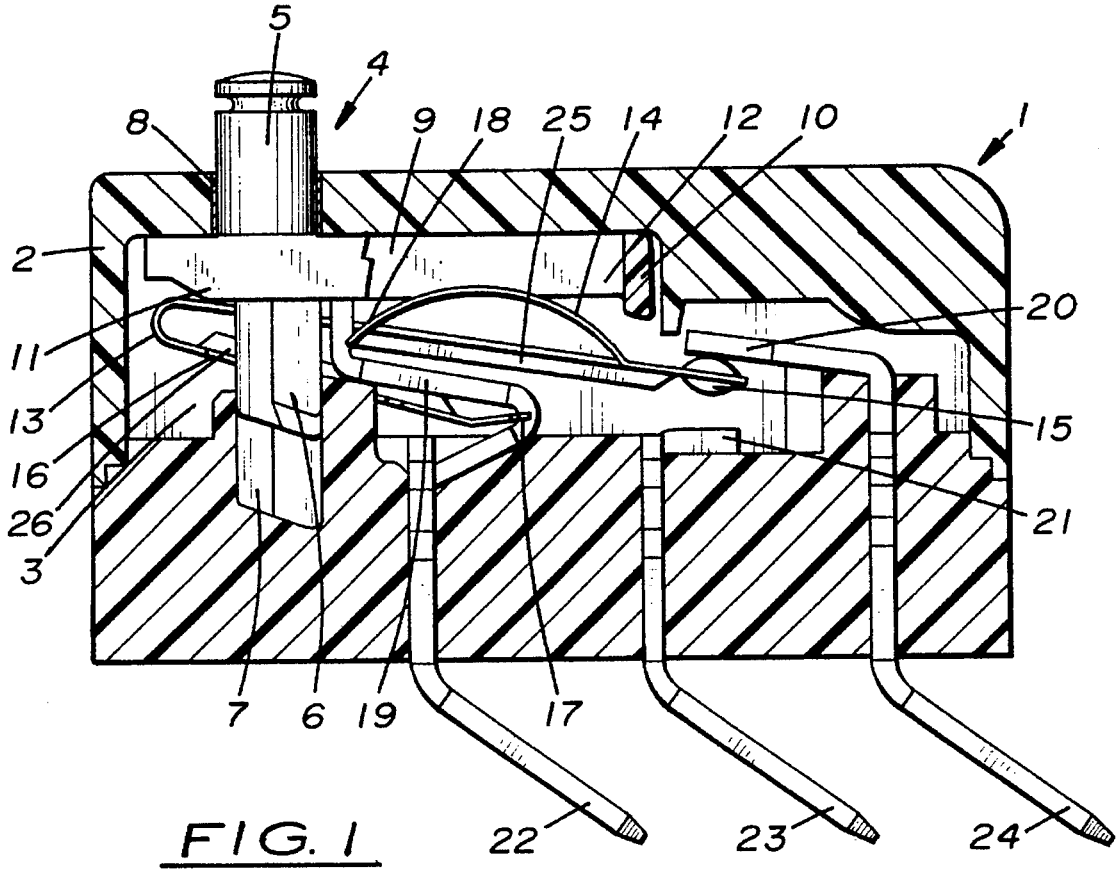

Microswitches are used in the field of industry, in the field of car manufacture and in telecommunication engineering. Microswitches have to fulfill high demands with regard to operational reliability and service life. In order to achieve a long service life, a high switching speed is, in particular, very important so that the burning of contacts occurring during the switching operation due to spark-over will be reduced. Normally, the movement applied by means of the switching tappet is too slow for carrying out direct switching over of the contacts. Hence, bistable spring arrangements are used, which produce a markedly higher switching speed with the switching speed decoupled from the speed at which the switching tappet moves. The bistable spring arrangement has the effect that the contacts will be released at a sufficiently high speed so that welding during the separation process as well as increased wear, which may be caused by slow motion, will be prevented. Also the closing of the contacts takes place at high speed. Notwithstanding this, welding between two switching contacts may still occur during operation, e.g. by excessively high currents or by oxidation of the contact points. It will thus be more difficult, or completely impossible to separate such a contact connection or to effect switching over of such a contact connection. This may cause serious damage in the circuits or apparatus connected to such contact connections. This is the reason for the fact that switches exist, which include means used for forced separation of welded contacts. These means will, however, essentially increase the structural expenditure and the space required for such a switch. This will cause structural problems in particular in switches having small dimensions or in microswitches.

It is the object of the present invention to provide a microswitch of the type mentioned at the beginning with structurally simple forced-separation means without causing any change in the overall size. Also in the case of welding of two switching contacts, it permits forced separation of the switching contacts. Its holding-down device is in direct contact with the contact bridge, and, by an introduction of force parallel to the direction of movement, the weld will be torn by means of said holding-down device.

It is particularly advantageous, when the switching tappet has, on the end located opposite the cantilever, an extension acting on the contact bridge in the direction of movement of the switching tappet. The distance between the switching contact and the extension is, in this case, larger and the switching speed higher, and this will cause less burning of contacts and it will reduce the tendency towards welding of the contacts.

It is advantageous to support the switching tappet in two axial guide means, which are arranged at the maximum possible distance from the center of the switch when seen in the axial direction, so as to avoid tilting and, consequently, blocking of the switching tappet if welding of contacts has occurred. A particularly space-saving structural design of the microswitch can be obtained by arranging the cantilever between these guide means. This arrangement is also advantageous for introducing the torque, which is generated by the cantilever, in the switch.

It is particularly advantageous to support the switching tappet such that it is secured against rotation for avoiding thus clamping of the switching tappet or of the cantilever in other structural components in the microswitch, e.g. when the switching tappet has applied thereto an axial torque or in cases in which it is used in a tilted mounting position.

If at least one of the guide means has an oval cross-section, the arrangement can be constructed such that it will have special flexural strength and that it will be secured against rotation in a particularly effective manner.

Furthermore, it turned out to be advantageous when the guide means for the switching tappet which is arranged in the interior of the housing has a T-shaped cross-section and when the part of the switching tappet guided in said guide means has a T-shaped cross-section as well. The arrangement can thus be constructed such that it will have special flexural strength, that its guiding accuracy will be high and that it will be secured against rotation.

In order to provide a forced separation which is effective throughout the whole actuator travel, it will be advantageous when the movement of the switching tappet can be continued until the holding-down device presses the contact bridge onto the fixed contact located opposite the fixed contact which is in engagement in the starting position.

The microswitch can be provided with a particularly compact structural design, when the holding-down device and the cantilever are formed integrally with the switching tappet.

A very compact structural design of the arrangement will also be possible, when the bistable spring arrangement comprises a compression spring which is connected to the contact bridge.

It will also be advantageous to construct the compression spring and the contact bridge such that they are formed integrally with one another, whereby the arrangement can be realized in a compact and structurally simple design comprising a small number of components.

The microswitch can be constructed in an advantageous manner when the contact bridge is bent into a clasplike shape and resiliently deformable. The number of structural components required can thus be reduced, since, in a functionally unifying manner, the contact bridge is utilized as an electrically conductive member as well as with respect to its property of returning, after a switching operation, automatically to its original position due to its resilience.

The feature that the cantilever is provided with a recess into which the compression spring projects permits a particularly compact structural design of the microswitch.

A particularly simple and space-saving arrangement can be obtained, when the free ends of the compression spring and of the contact bridge engage, in a pretensioned condition, notches which are provided in the interior of the housing and which are directed towards opposite sides, at least one of said notches being connected to a fixed contact in an electrically conductive manner. This will have the effect that only a small number of structural components is required and that no additional fastening or connection elements will be necessary.

When these notches are arranged on a fixed contact, the number of components required and the number of operational steps necessary for producing the microswitch can be reduced still further.

In this connection, it proved to be particularly advantageous to provide the fixed contact with an S-shaped structural design and to support the free ends of the compression spring and of the contact bridge, in a pretensioned condition, in the bends of the free end of the fixed contact having the shape of an S curve, whereby the arrangement can be constructed in a space-saving manner using only a small number of components.

When the contact bridge is provided with an opening through which the switching tappet can extend, the microswitch can be provided with a particularly space-saving structural design.

Figure 2A:
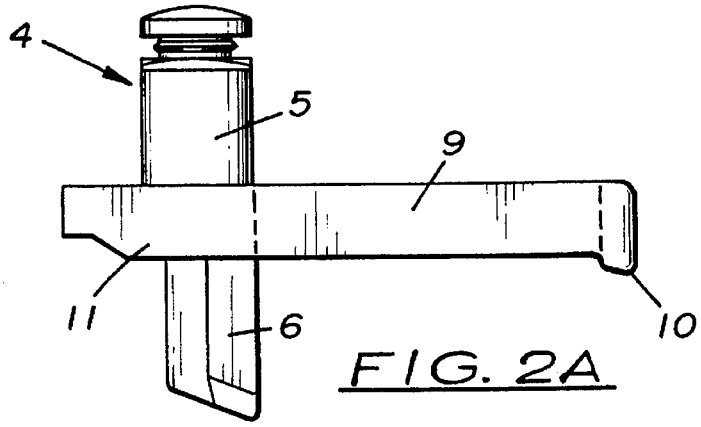
Figure 2B:
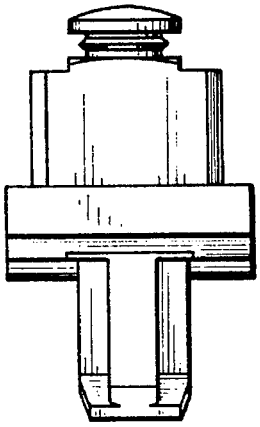
Figure 2C:
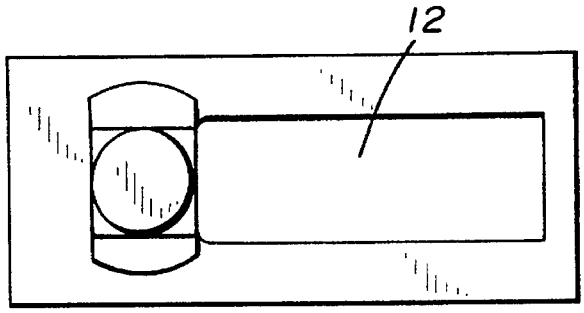
Figure 3:
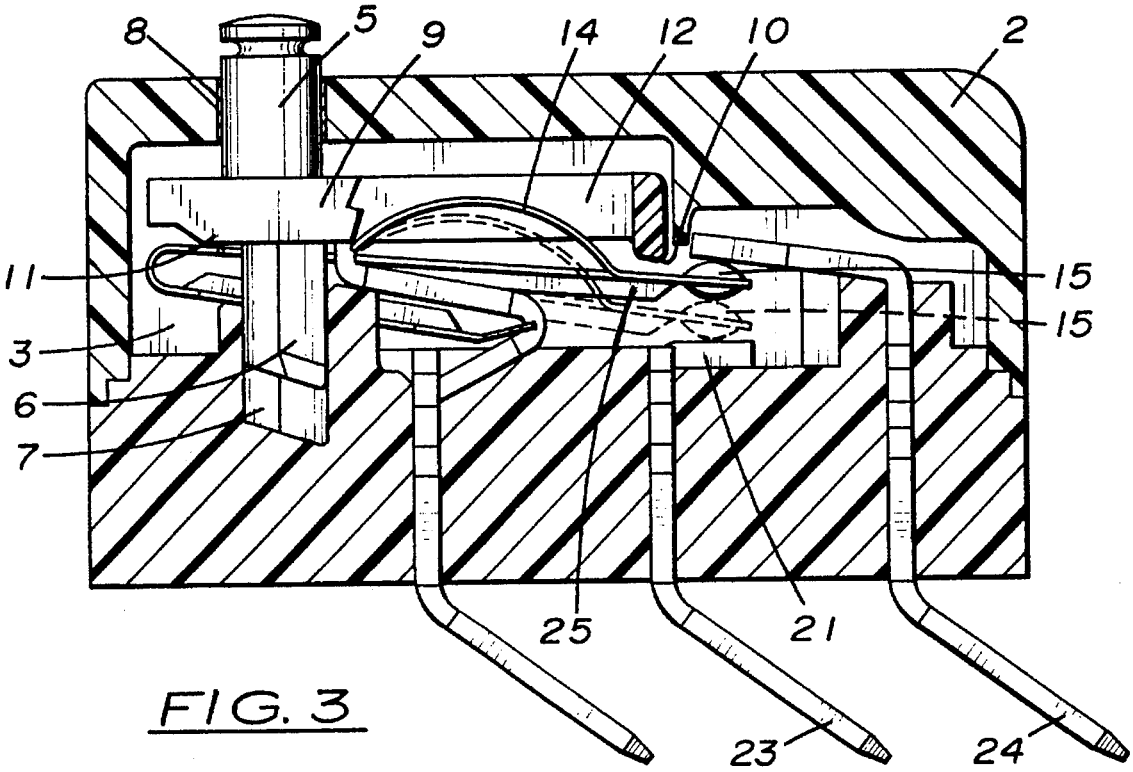
Figure 4:
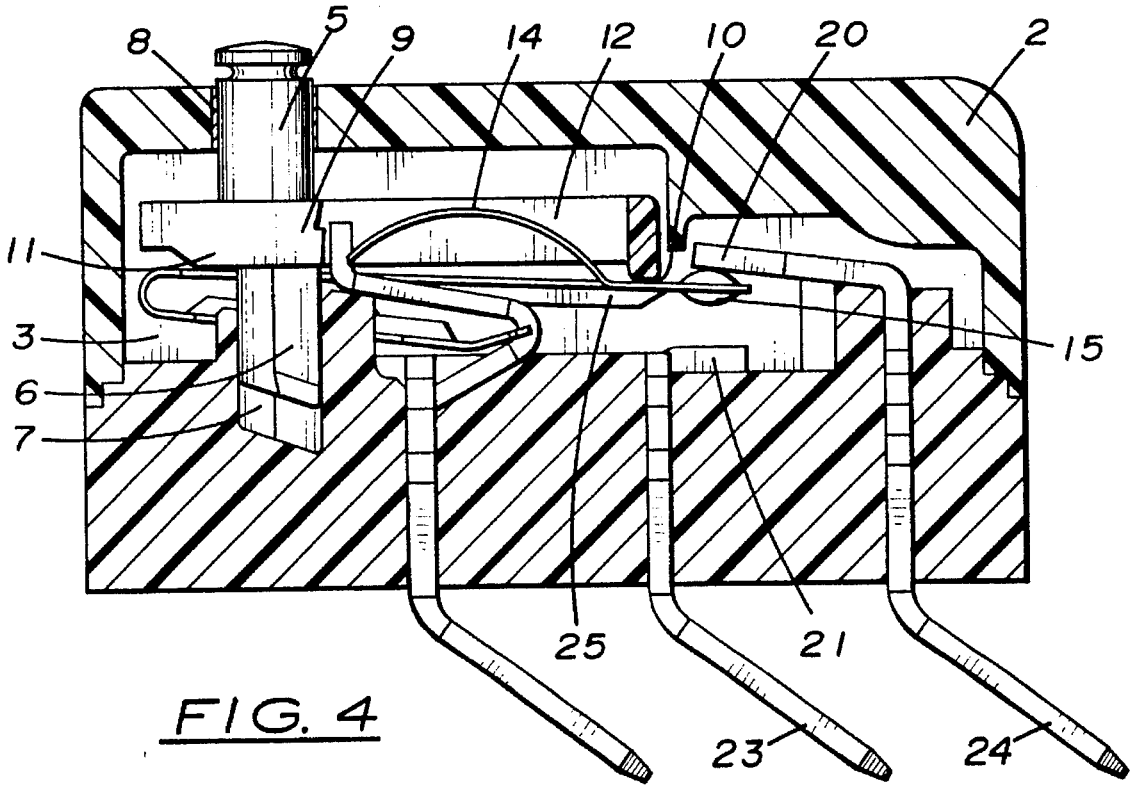
Figure 5:
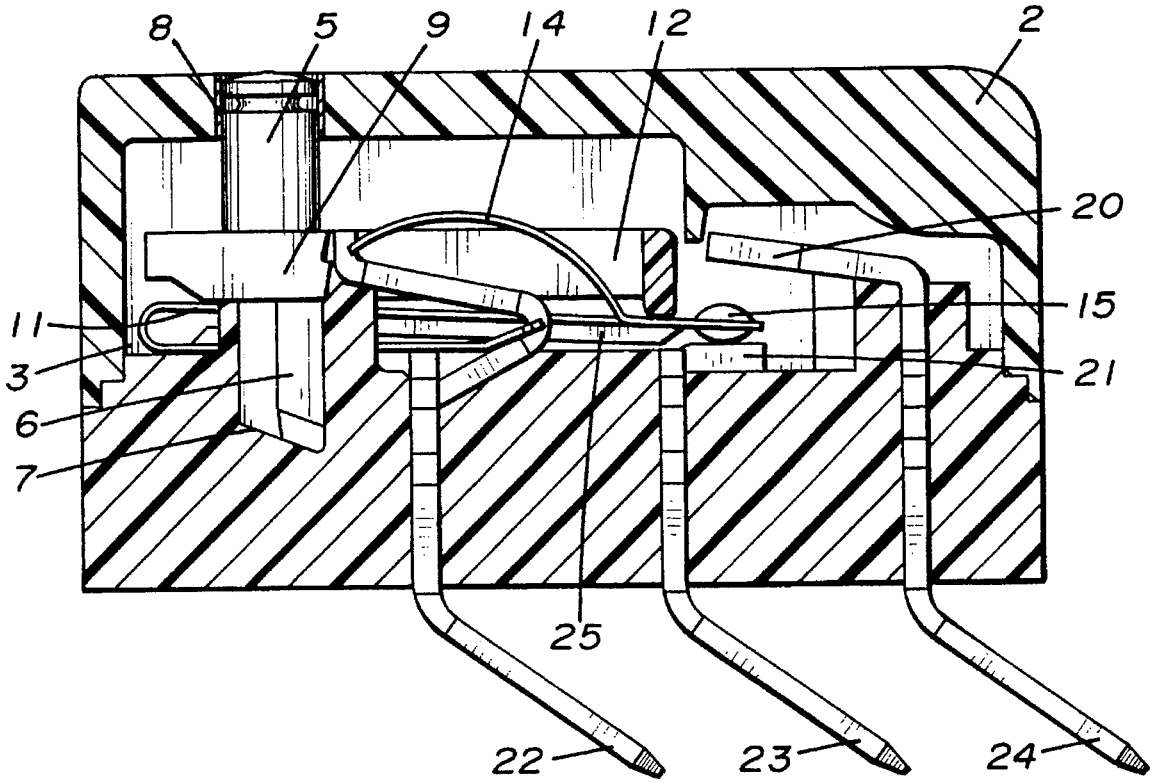

In the following, one embodiment will be explained in detail on the basis of a drawing, in which FIG. 1 shows a sectional view of the microswitch in the starting position, FIGS. 2A, 2B and 2C shows respective side, end and top views of the switching tappet with cantilever and holding-down device, FIG. 3 shows the microswitch in a sectional view at the moment of switching over without worn contacts, FIG. 4 shows a sectional view of the microswitch, the holding-down device occupying the position of initial engagement, FIG. 5 shows a sectional view of the microswitch, the switching tappet being in its end position.

The drawing shows a microswitch in a sectional view, said microswitch comprising a housing 2 with a housing interior 3. The housing 2 has arranged therein a switching tappet 4, which is provided with two axial guide means 5, 6 received in two bearings 7, 8 in said housing 2. The guide means 6 arranged in the housing interior 3 has, just as the associated bearing 7, a T-shaped cross-section, whereas the guide means 5, which is located opposite said guide means 6, and the bearing 8 associated therewith have an oval cross-section. Furthermore, a holding-down device 10 is attached to the free end of the switching tappet 4 via a cantilever 9. An extension 11 is arranged on the side of the switching tappet 4 located opposite the cantilever 9. In addition, the switching tappet 4 has a recess 12 (FIG. 2C) which is arranged in the cantilever. The extension 11 of the switching tappet 4 acts on a resiliently deformable and electrically conductive contact bridge 13, which is bent into a clasplike shape and which comprises a bistable spring arrangement consisting of a compression spring 14 projecting into the recess 12 and of a switching contact 15. Furthermore, the contact bridge 13 is provided with an opening 16 in the area of the switching tappet 4, said switching tappet 4 extending through said opening 16. The compression spring 14 and the contact bridge 13 are formed integrally and are supported on both sides in indentations 17, 18 of a fixed contact 19 bent into an S-shape, the contact bridge 13 being thus held in position and being connected to the fixed contact 19 in an electrically conductive manner. In the area of engagement of the switching contact 15, two fixed contacts 20, 21 are arranged, which, just as is the fixed contact 19, are connected in an electrically conductive manner to connection contacts 22, 23, 24 attached to and extending the outside of the housing 2. In addition, reinforcements 25, 26 are provided on the straight portions of the contact bridge 13 which is bent into a clasplike shape.

For the sake of clarity, FIGS. 2A 2B and 2C show different views of the switching tappet 4, this being particularly useful with respect to the arrangement of the cross-sections of the axial guide means 5, 6 of the switching tappet 4.

In the following, the mode of operation of the microswitch will be explained in detail.

In the starting or normal position, the compression spring 14, supported by the force of the resilient contact bridge 13, has the effect that the switching contact 15 is held in the first switching position. In this position, the connection contact 22 is connected to the connection contact 24 via the fixed contact 19, the contact bridge 13, the switching contact 15 and the fixed contact 20. When the switching tappet 4 is now urged into the housing 2 by an externally applied force, the extension 11 of the switching tappet 4 will act on the contact bridge 13 parallel to its direction of movement, and this causes a resilient deformation of said contact bridge. In the course of this process, the switching tappet 4 is guided with the aid of two axial guide means 5, 6 in bearings 7, 8 associated with said guide means. Due to the shape of said guide means 5, 6 and of the bearings 7, 8 associated therewith, the switching tappet 4 is supported such that it is secured against rotation and adapted to be displaced in the axial direction. When the movement of the switching tappet 4 into the housing 2 is continued, the line of effect of the compression spring 14 tilts until, in the switching position, said line of effect of the compression spring 14 comes to lie in the plane defined by the contact line between the contact bridge 13 and the extension 11 and by the connecting line extending along the transition from the compression spring 14 to the contact bridge 13. If the contact between the switching contact 15 and the fixed contact 20 is not welded and thus freely separable, instantaneous switching over of the contact takes place at high speed as soon as the switching tappet 4 has been moved into the housing beyond the switching point, and this switching over releases the connection between the switching contact 15 and the fixed contact 20 and establishes the connection between the switching contact 15 and the fixed contact 21, since relative to the plane defined by the contact line between the contact bridge 13 and the extension 11 and by the connecting line extending along the transition from the compression spring 14 to the contact bridge 13, the direction of effect of the compression spring 14 is now directed towards the base and causes switching over of the switching contact 15. When switching over has been carried out, the movement of the switching tappet 4 can be stopped. In cases in which the contact between the fixed contact 20 and the switching contact 15 is welded and switching over cannot take place, the holding-down device 10 comes into engagement with the contact bridge 13 a short time after the switching tappet 4 has moved beyond the switching point. If the switching tappet 4 is urged further down into the housing 2, said holding-down device 10 applies to the contact bridge 13 a force introduced parallel to the direction of movement of the switching tappet 4, and this has the effect that the weld is forcily torn. Following this, the compression spring 14 causes switching over of the contact, since the switching tappet 4 has already been moved beyond the switching point. In order to guarantee that the weld is separated, the switching tappet can be urged down into the housing until the holding-down device 10 presses the contact bridge 13 directly onto the fixed contact 21. When the switching tappet 4 is released, the resilient contact bridge 13 cause the switching tappet 4 to be urged out of the housing 2 via the extension 11, and this has the effect that the holding-down device 10 is moved away from the switching contact 15. Analogously to the switching over described hereinbefore, the bistable spring arrangement will here again cause switching over of the contacts. In this case, however, the switching is supported by the spring action of the resilient contact bridge 13, whereby the connection between the switching contact 15 and the fixed contact 21 is separated and the connection between the switching contact 15 and the fixed contact 20 is established.

I claim:

1. A microswitch comprising a housing having opposite sides, an interior, and a center, a switching tappet projecting beyond said housing and arranged such that it is offset relative to the center of said housing and having first and second switching positions and a direction of movement therebetween, connection contacts arranged on the side of the housing located opposite said switching tappet and connected in an electrically conductive manner with fixed contacts positioned in the interior of said housing, and a contact bridge adapted to be moved from a first to a second switching position via the switching tappet and provided with at least one switching contact, said contact bridge being held in said first or second switching position by means of a bistable spring arrangement depending on whether said switching tappet is in its first or second position, characterized in that the switching tappet is provided with opposite ends and a cantilever projecting on one said end and having attached thereto at said one end a holding-down device, which, in the first switching position of the contact bridge, is arranged at a small distance from said contact bridge and which, in the second switching position, projects into the path along which the contact bridge moves.

2. A microswitch according to claim 1, characterized in that on its end located opposite said end with a cantilever, the switching tappet has an extension acting on the contact bridge parallel to said direction of movement of the switching tappet.

3. A microswitch according to claim 1, characterized in that said switching tappet is provided with two axial guide means, one of said axial guide means being arranged in the interior of the housing, and that the cantilever of said switching tappet is arranged between the two guide means.

4. A microswitch according to claim 3, characterized in that said switching tappet is arranged such that it is secured against rotation.

5. A microswitch according to claim 3, characterized in that one of said guide means has an oval cross-section and is supported in a bearing in said housing having an oval cross-section as well.

6. A microswitch according to claim 3, characterized in that the guide means for said switching tappet which is arranged in the interior of said housing has a T-shaped cross-section and engages a bearing having a T-shaped cross-section as well.

7. A microswitch according to claim 1, characterized in that, in the second switching position of said switching tappet, said holding-down device presses said switching contact against a said fixed contact.

8. A microswitch according to claim 1, characterized in that said cantilever is an integral part of said switching tappet.

9. A microswitch according to claim 1, characterized in that said bistable spring arrangement comprises a compression spring which is connected to said contact bridge.

10. A microswitch according to claim 9, characterized in that said compression spring is formed integrally with said contact bridge.

11. A microswitch according to claim 9, characterized in that said contact bridge is bent into a clasplike shape and is resiliently deformable.

12. A microswitch according to claim 11, characterized in that said cantilever is provided with a recess into which said compression spring projects.

13. A microswitch according to claim 9, characterized in that the ends of said compression spring and of said contact bridge engage, in a pretensioned condition, indentations are provided in the interior of said housing and directed toward opposite sides thereof, at least one of said indentations being connected to a said fixed contact in an electrically conductive manner.

14. A microswitch according to claim 13, characterized in that said indentations are arranged on said fixed contact.

15. A microswitch according to claim 14, characterized in that the ends of said compression spring and of said contact bridge are supported, in a pretensioned condition, in the bends of said fixed contact having the shape of an S curve provided with indentations.

16. A microswitch according to claim 1, characterized in that said contact bridge is provided with at least one opening through which said switching tappet extends.

* * * * *